US006105380A

United States Patent [19]

Yokomachi et al.

[11] Patent Number: 6,105,380

[45] Date of Patent: Aug. 22, 2000

[54] REFRIGERATING SYSTEM AND METHOD OF OPERATING THE SAME

[75] Inventors: Naoya Yokomachi; Takashi Ban; Toshiro Fujii; Tatsuya Koide, all of Kariya; Shin Nishida, Anjo, all of Japan

[73] Assignees: Kabushiki Kaisha Toyoda Jidoshokki Seisakusho; Denso Corporation, both of Kariya, Japan

[21] Appl. No.: 09/292,409

[22] Filed: Apr. 15, 1999

[30] Foreign Application Priority Data

Apr. 16, 1998 [JP] Japan ..... 10-106721

[51] Int. Cl.[7] ..... F25B 49/02

[52] U.S. Cl. ..... 62/228.3; 62/217; 62/114

[58] Field of Search ..... 62/228.1, 228.3, 62/228.4, 228.5, 217, 114, 174, 502, 216, 226, 227, 208, 209, 210, 203, 204

[56] References Cited

U.S. PATENT DOCUMENTS

| | | | |
|---|---|---|---|
| 4,205,532 | 6/1980 | Brenan | 62/114 X |
| 5,245,836 | 9/1993 | Lorentzen et al. | 62/174 |
| 5,497,631 | 3/1996 | Lorentzen et al. | 62/174 X |
| 5,655,378 | 8/1997 | Pettersen | 62/174 |
| 5,685,160 | 11/1997 | Abersfelder et al. | 62/114 |

FOREIGN PATENT DOCUMENTS

| | | |
|---|---|---|
| 0 604 417 B1 | 7/1994 | European Pat. Off. . |
| 1-142276 | 6/1989 | Japan . |
| 6-173852 | 6/1994 | Japan . |

OTHER PUBLICATIONS

Lorentzen, et al., "A new, efficient and environmentally benigh system for car air–conditioning," *Int. J. Refrig.*, vol. 16, No. 1, 1993, pp. 4–12.

*Primary Examiner*—Harry B. Tanner
*Attorney, Agent, or Firm*—Woodcock Washburn Kurtz Mackiewicz & Norris LLP

[57] ABSTRACT

The present invention relates to a refrigerating system and a method of operating a refrigerating system. The refrigerating system includes a compressor, a gas cooler used as a heat-dissipation type heat exchanger, an expansion valve used as a throttling means, an evaporator used as a heat-absorption type heat exchanger and an accumulator, which are connected in series with each other to form a closed circuit. The closed circuit is adapted so that the higher pressure of the closed circuit becomes the supercritical pressure of a refrigerant circulating the closed circuit. This has a control characteristic property wherein the lower evaporating pressure increases as the higher pressure increases. The lower evaporating pressure and the higher pressure are detected, respectively, and if the detected value of the lower evaporating pressure is lower than a target value for the lower evaporating pressure determined based on the above control characteristic property in correspondence to the detected value of the higher pressure, the discharge capacity of the compressor is reduced so that the lower evaporating pressure coincides with the target value.

13 Claims, 5 Drawing Sheets

REFRIGERATING SYSTEM AND METHOD OF OPERATING THE SAME

BACKGROUND OF THE INVENTION

1. Field of the Invention

The present invention generally relates to a refrigerating system and a method of operating the same system. More particularly, the present invention relates to a method of operating a refrigerating system wherein at least a compressor, a heat-dissipation type heat exchanger, a throttling means and a heat-absorption type heat exchanger are connected in series to form a closed circuit, which includes a first refrigerant circuit section having a higher pressure and a second refrigerant circuit section having a lower evaporating pressure, so that the higher pressure in the closed circuit becomes the supercritical pressure of the refrigerant circulating in the closed circuit. Further, the present invention relates to a refrigerating system carrying out the said method. The refrigerating system and the method of operating the same system according to the present invention can be suitably used in an air-conditioner for an automobile.

2. Description of the Related Art

The refrigerating system disclosed in Japanese Unexamined Patent Publication (Kohyo) No. 6-510111 on the basis of PCT/NO91/00119, includes a compressor, a heat-dissipation type heat exchanger (gas cooler), a throttling means, a heat-absorption type heat exchanger (evaporator) and a vapor-liquid separator (accumulator), which are connected in series with each other to form a closed circuit, the refrigerating system being operated so that the higher pressure in the closed circuit becomes the supercritical pressure of the refrigerant circulating in the closed circuit. In this refrigerating system, the higher pressure is adjusted by detecting at least one operating condition such as the exit temperature of the gas cooler disposed on the higher pressure side as a heat-dissipation type heat exchanger and controlling the throttling means disposed downstream from the gas cooler in accordance with the detected operation condition(s), to minimize an energy consumption in the refrigerating system.

To minimize the energy consumption in a refrigerating system, the system should be operated under conditions wherein a coefficient of performance (COP=Q/W) becomes a maximum as defined by a ratio of a refrigerating performance (Q) of the evaporator to a compression work (w) applied to the compressor from outside. In this regard, as is apparent from the above equation, the value of COP is determined from both the refrigerating performance (Q) and the compression work (W). The larger the refrigerating performance (Q) of the evaporator; i.e., an enthalpy change of a refrigerant during the passage thereof through the evaporator (the difference in enthalpy between an exit of the evaporator and an entrance thereof); and the smaller the compression work (W) necessary for compressing the refrigerant in the compressor, the larger the above-mentioned value of COP.

In a refrigerating system operated under conditions where the higher pressure in the closed circuit constituting the refrigerating system becomes the supercritical pressure of refrigerant (such an system may properly be referred to as "a supercritical cycle refrigerating system" hereinafter), it is possible to increase the above-mentioned value of COP by increasing the higher pressure in the closed circuit constituting the refrigerating system and thereby increasing the above-mentioned refrigerating performance (Q), provided the refrigerant is maintained generally at a constant temperature at the exit of the gas cooler. Such a condition is never seen in a refrigerating system operating under conditions where both the higher pressure and the lower pressure are lower than the critical pressure of refrigerant (such an system may properly be referred to as "a subcritical cycle refrigerating system"). Accordingly, the action of the throttling means in the former is different from that in the subcritical cycle system.

In other words, as shown, in a pressure-enthalpy diagram of FIG. 7 which is a P-H diagram or Mollier diagram in a supercritical cycle using carbon dioxide ($CO_2$) as a refrigerant, the refrigerating performance (Q) in the evaporator becomes larger as the difference ($\Delta H_1=H_A-H_D$) between enthalpy ($H_D$) at the entrance (point D) of the evaporator and enthalpy ($H_A$) at the exit (point A) thereof increases and as a mass flow rate of refrigerant circulating in the evaporator increases. When the degree of superheating becomes excessively larger at the exit of the evaporator (point A), the specific volume of refrigerant sucked into the compressor increases, and the volumetric efficiency of the compressor decreases, in accordance with the temperature increase of the discharged gas, which causes a reduction in the circulation rate of the refrigerant (the amount of refrigerant supplied to the evaporator within a unit time; kg/h), resulting in the deterioration of refrigerating performance (Q). To keep the degree of superheating at an approximately constant value and thereby to avoid the deterioration of refrigerating performance due to the reduction in the circulation rate of the refrigerant, it is necessary to maintain the enthalpy ($H_A$) at the exit of the evaporator (point A) at an approximately constant value. The enthalpy ($H_D$) at the entrance of the evaporator (point D) is equal to an enthalpy ($H_C$) at an exit of the gas cooler (point C) because the expansion process is isenthalpic in the throttling means. Accordingly, it is possible to increase the difference ($\Delta H_1$) between the enthalpy ($H_D$) at the entrance of the gas cooler (point D) and the enthalpy ($H_A$) at the exit of the evaporator (point A) and, therefore, the refrigerating performance (Q), by reducing the enthalpy ($H_C$) at the exit of the gas cooler (point C). Since the higher pressure inside the gas cooler, wherein the refrigerant is under a supercritical pressure, is a single phase zone of high pressure vapor, the higher pressure is adjustable independently of the refrigerant temperature at the exit of the gas cooler (point C). If the refrigerant temperature is kept approximately constant at the exit of the gas cooler (point C) (for example, at 40° C.; this temperature being approximately equal to that of the environmental air which exchanges heat with the refrigerant in the gas cooler), the enthalpy ($H_C$) at the exit of the gas cooler (point C) is reduced as the higher pressure increases, as is apparent from an isothermal curve for 40° C. shown in the P-H diagram of FIG. 7. Accordingly, it is possible to increase the above-mentioned refrigerating performance ($Q=\Delta H_1$) and, therefore, the COP, by increasing the higher pressure to reduce the enthalpy ($H_C$) at the exit of the gas cooler (point C), if the refrigerant temperature at the exit of the gas cooler (point C) is kept approximately constant.

On the other hand, if the higher pressure is increased while maintaining the refrigerant temperature at the exit of the gas cooler (point C) at an approximately constant value (for example, 40° C.), the compression work necessary for the compressor ($W=\Delta H_2=H_B-H_A$) increases in accordance therewith. In this regard, an assumption is made that the compression in the compressor is adiabatic, the compression process is an isothermal change, and the compression work (w) is equal to the difference between the enthalpy ($H_A$) at the entrance of the compressor (point A) and the enthalpy ($H_B$) at the exit of the compressor (point B). Therefore, if the higher pressure becomes excessively high, the above-mentioned COP falls due to the increase in compression work (W).

From the facts stated above, there is an optimum value of the higher pressure under which the COP value, determined by the relationship between the refrigerating performance (Q) and the compression work (W), becomes a maximum when the refrigerant temperature at the exit of the gas cooler (point C) is at a certain value. If the optimum values of the higher pressures at various refrigerant temperatures at the exit of the gas cooler (point C) are obtained, an optimum control curve will be determined, as shown in FIG. 7.

In the supercritical cycle refrigerating system disclosed in the above-mentioned Japanese Unexamined Patent Publication (Kohyo) No. 6-510111, the refrigerant temperature and pressure are detected at the exit of the gas cooler (point C), and the optimum value of the higher pressure at the detected temperature is determined based on the above-mentioned optimum control curve. Thereafter, the throttling means is controlled in accordance with an actual higher pressure so that the actual pressure becomes the optimum pressure thus determined, whereby the COP value is maximized and the energy consumption in the refrigerating system is minimized.

In the automobile air conditioner wherein the rotation of an engine is used as an drive source for the compressor, there might be a case where, when the rotational speed of the engine increases, a power of the compressor also increases in accordance therewith, which in turn increases a circulation rate of refrigerant in the evaporator (kg/h) to excessively increase the refrigerating performance (Q). To avoid such excessive refrigeration due to the increase in the rotational speed, it is necessary to reduce the opening degree of the throttling means and thus decrease the circulation rate of the refrigerant. However, it is impossible to effectively prevent excessive refrigeration by merely reducing the opening degree of the throttling means, since the refrigerant temperature is lowered to a saturation temperature corresponding to a refrigerant pressure as the refrigerant pressure drops in the evaporator. Accordingly, when the engine rotational speed increases, not only must the opening degree of the throttling means be reduced, but also the discharge capacity of the compressor must be decreased. That is, if a variable displacement type compressor is employed, capable of varying a discharge capacity by detecting a suction pressure (a refrigerant pressure at the exit of the evaporator) or a refrigerant temperature at the exit of the evaporator, so that the discharge capacity of the compressor becomes smaller when the engine rotational speed increases, it must be expected that the refrigerant temperature increases in the evaporator due to the decrease in the refrigerant circulation rate and the increase in the suction pressure (i.e., the increase in the refrigerant pressure in the evaporator) due to the reduction in the discharge capacity, which can effectively prevent excessive refrigeration from occurring when the rotational speed increases.

However, the above-mentioned supercritical cycle refrigerating system has several problems. For example, when the discharge capacity of the compressor is modulated with the same control characteristic as that of the refrigerating system of subcritical cycle, it is difficult to quickly carry out the capacity control of the compressor when the engine rotational speed increases, because the action of the throttling means is different in the supercritical cycle from that in the subcritical cycle.

That is, according to the throttling means in the subcritical cycle refrigerating system, the refrigerant temperature is detected at the exit of the evaporator, and the optimum pressure corresponding to this detected temperature is compared with the actual refrigerant pressure at the exit of the evaporator to control the throttling means so that the actual refrigerant pressure at the exit of the evaporator becomes optimum. In this respect, the optimum pressure at the exit of the evaporator means a pressure under which the degree of superheating of the refrigerant is constant at the exit of the evaporator. More specifically, if the detected refrigerant temperature at the exit of the evaporator is, for example, 8° C., an optimum pressure under which a constant degree of superheating (for example, 5° C.) is obtained is defined (the saturation temperature corresponding to this optimum pressure is 3° C.). Therefore, the circulation rate of the refrigerant through the evaporator is adjusted by controlling the opening degree of the throttling means so that the actual refrigerant pressure at the exit of the evaporator becomes the optimum pressure. In such a manner, it is possible to carry out the refrigerating operation, under the conditions at which the COP value becomes maximum, by controlling the opening degree of throttle means in accordance with the refrigerant temperature at the exit of the evaporator to adjust the refrigerant pressure at the exit of the evaporator so that the degree of superheating is maintained at a constant value.

When the engine rotational speed and, therefore, the rotational speed of a driving shaft of the compressor increases in the subcritical cycle refrigerating system wherein the throttling means operates in such a manner, the refrigerant is not completely vaporized in the evaporator due to the increase in the circulation rate of the refrigerant supplied to the evaporator from the compressor, and the refrigerant temperature is lowered at the exit of the evaporator in correspondence to the degree of superheating. If the refrigerant temperature is lowered at the exit of the evaporator, the optimum pressure is also lowered in accordance with the refrigerant temperature. Accordingly, the opening degree of the throttling means is reduced in order to lower the actual refrigerant pressure, at the exit of the evaporator, to the above-mentioned optimum pressure. Since the resistance against the refrigerant flow increases due to the throttling action of the throttling means, the circulation rate of the refrigerant through the evaporator is reduced. Also, since the refrigerant pressure in the evaporator is lowered, in accordance with the reduction in the circulation rate of the refrigerant, to lower the suction pressure of the compressor, the volumetric efficiency of the compressor deteriorates. Accordingly, due to the reduction in the circulation rate of the refrigerant in the evaporator and the deterioration of the volumetric efficiency of the compressor, the refrigerating performance is lowered to prevent excessive refrigeration. Further, since the suction pressure of the compressor and the refrigerant temperature at the exit of the evaporator are quickly lowered due to the throttling action of the throttling means, it is possible, by detecting such values, to quickly carry out the volumetric control of the compressor, which also prevents excessive refrigeration.

As stated above, in the subcritical cycle refrigerating system, since the throttling means quickly acts in the throttling direction, even if the rotational speed excessively increases, excessive refrigeration is assuredly prevented by reducing the circulation rate of the refrigerant and other measures. Also, since the throttling means acts in the throttling direction to quickly lower the suction pressure of the compressor, it is possible to quickly and assuredly carry out the volumetric control of the compressor by detecting such a suction pressure and other measures and, as a result, to prevent excessive refrigeration from occurring.

On the contrary, in the supercritical cycle refrigerating system, the maximization of COP and therefore the minimization of the energy consumption in the refrigerating system is achieved by adjusting the opening degree of the throttling means based on the detected refrigerant temperature and pressure at the exit of the gas cooler (point C), as stated above, so that the actual refrigerant pressure at the exit of the gas cooler (point C) becomes the optimum pressure at the detected temperature.

When the engine rotational speed and, therefore, the rotational speed of the driving shaft of the compressor increase in the refrigerating system of supercritical cycle in which the throttling means acts as described above, a mass flow rate of the refrigerant supplied to the gas cooler also increases, whereby a refrigerant pressure in the gas cooler (a higher pressure; a discharge pressure) becomes also higher. On the other hand, since the opening degree of the throttling means is adjusted so that the refrigerant pressure at the exit of the gas cooler is maintained at a constant value as stated above, the opening degree of the throttling means is made large to suppress the increase of the refrigerant pressure at the exit of the gas cooler. This causes a problem in that the action of the throttling means in the throttling direction lags to delay the adjustment of the refrigerating performance. Also, if the action of the throttling means in the throttling direction lags, the discharge pressure promptly increases, while the lowering of the suction pressure delays, which result in the delay of the volumetric control of the compressor based on the detection of the suction pressure or other measures and cause the delay of the adjustment of the refrigerating performance.

SUMMARY OF THE INVENTION

It is therefore an object of the present invention to provide a supercritical cycle refrigerating system, and a method of operating the same, capable of quickly adjusting the refrigerating performance, so that excessive refrigeration due to the increase of the rotational speed is assuredly prevented from occurring even if the rotational speed increases.

According to one aspect of the present invention, there is provided a method of operating a refrigerating system which includes at least a compressor, a heat-dissipation type heat exchanger, throttling means and a heat-absorption type heat exchanger which are connected in series with each other to form a closed circuit for circulating a refrigerant, the closed circuit including a first refrigerant circuit section having a higher pressure and a second refrigerant circuit section having a lower evaporating pressure, the method comprising the steps of: operating the refrigerating system so that the higher pressure in the closed circuit becomes the supercritical pressure of the refrigerant circulating in the closed circuit; and controlling the refrigerating system so that the lower evaporating pressure increases as the higher pressure increases.

This operating method is based on a control characteristic property represented by an upwardly slanted straight line or curve of a predetermined inclination angle in coordinates defined by x axis representing the higher pressure and y axis representing the lower evaporating pressure. When the actual lower evaporating pressure is lower than a target value for the lower evaporating pressure determined in correspondence to the actual higher pressure, the refrigerant circulation rate is controlled so that the lower evaporating pressure coincides with the target value. This means that when the refrigerant circulation rate is controlled in a variable manner while using the lower evaporating pressure as a preset pressure, or more concretely when the refrigerant circulation rate is controlled to be reduced if the lower evaporating pressure becomes lower than the preset pressure, the control characteristic property is such that the preset pressure becomes higher as the higher pressure increases (or when the operation of the compressor is controlled in an ON-OFF manner, via an electromagnetic clutch mounted on the driving shaft of the compressor, while using the evaporating temperature in correspondence to the lower evaporating pressure as a preset temperature, or more concretely when the control is carried out in such a manner that if the evaporating temperature becomes lower than a first preset temperature $t_1$, the electromagnetic clutch of the compressor is turned off, and if the evaporating temperature becomes higher than a second preset value $t_2$ ($>t_1$), the electromagnetic clutch of the compressor is turned on, the control characteristic property being such that the preset temperature $t_1$ becomes higher as the higher pressure increases). In this regard, for the purpose of variably controlling the refrigerant circulation rate, a discharge capacity of the compressor may be variably controlled or the opening degree of a suction throttle valve provided at a position upstream from the compressor may be variably controlled.

According thereto, when the rotational speed of an engine, i.e., that of a driving shaft of the compressor increases, the higher pressure is quickly increasing as described before, while, even if the lowering of the lower evaporating pressure is delayed due to the delay of the throttling operation of the throttling means, it is possible to quickly lower the lower evaporating pressure to below the preset pressure value since the control characteristic property is such that the preset value of the lower evaporating pressure becomes higher as the higher pressure increases. Therefore, it is possible to quickly reduce the refrigerant circulation rate to lower the refrigerating performance, and thus to assuredly prevent excessive refrigeration when the rotational speed increases.

Preferably, in the above-described method of operating a refrigerating system, a variable displacement type compressor capable of varying a discharge capacity is used as the compressor.

In this operating method wherein the variable displacement type compressor capable of varying the discharge capacity is used, the discharge capacity of the compressor is variable while using the lower evaporating pressure as a preset pressure. That is, when the lower evaporating pressure becomes lower than the preset pressure, the discharge capacity of the compressor is reduced, which results in the reduction in the circulation rate of the refrigerant through the evaporator and thus the reduction of the refrigerating performance.

In a preferred embodiment, the above-described method of operating a refrigerating system is conducted, wherein the discharge capacity of the variable displacement type compressor is reduced as the higher pressure in the first circuit section increases.

In this operating method, the variable displacement type compressor is used, which is capable of increasing the interior pressure in the crank chamber thereof as the higher pressure increases and capable of reducing the discharge rate based on the increase in the interior pressure in the crank chamber. Accordingly, as the higher pressure increases, the interior pressure in the crank chamber also is increased to reduce the discharge capacity of the compressor, whereby the lower evaporating pressure increases based thereon.

Further preferably, the method of operating a refrigerating system may further comprise the steps of: detecting a refrigerant pressure prior to compression as the lower evaporating pressure and a refrigerant pressure after compression as the higher pressure, respectively; predetermining a control characteristic property so that a target value for the lower evaporating pressure in the closed circuit increases as the higher pressure in the closed circuit increases; determining the target value for the lower evaporating pressure corresponding to the detected higher pressure based on the predetermined control characteristic property; and reducing the discharge rate from the compressor so that the lower evaporating pressure coincides with the target value, when the detected lower evaporating pressure is lower than the determined target value for the lower evaporating pressure.

In this operating method, the lower evaporating pressure and the higher pressure are detected. Based on the control characteristic property predetermined so that the lower evaporating pressure increases as the higher pressure increases, the target value for the lower evaporating pressure is determined in correspondence with the detected higher pressure. If the actual detected value of the lower evaporating pressure is lower than the target value, the discharge capacity of the compressor is made to reduce so that the lower evaporating pressure coincides with the target value. Therefore, it is possible to carry out the operation of the refrigerating system having the control characteristic property wherein the lower evaporating pressure becomes higher as the higher pressure increases.

Preferably, the control characteristic property represents an upwardly inclined generally straight line shown in coordinates defined by an ordinate representing the lower evaporating pressure and an obscissa representing the higher pressure.

Also, preferably, the lower evaporating pressure of the refrigerant is a detected pressure of the refrigerant prior to being taken into the compressor, while the higher pressure of the refrigerant is a detected pressure of the refrigerant discharged from the compressor.

In a preferred embodiment, the method of operating a refrigerating system is provided, wherein a fixed displacement type compressor is used as said compressor and a suction throttle valve is provided at a position upstream from the fixed displacement type compressor in the closed circuit, and wherein the suction pressure of the fixed displacement type compressor is adjustably controlled by adjustably changing the opening degree of the suction throttle valve in accordance with the lower evaporating pressure of the refrigerant prior to entering the compressor.

In this operating method, the suction pressure of the fixed displacement type compressor and the refrigerating performance are adjusted by controlling the opening degree of the suction throttle valve in accordance with the lower evaporating pressure. That is, when the lower evaporating pressure is higher than the preset pressure, the opening degree is enlarged, and when the lower evaporating pressure is lower than the preset pressure, the opening degree is reduced. If the opening degree of the suction throttle valve is enlarged, the suction pressure of the compressor increases and the lower evaporating pressure is reduced to enforce the refrigerating performance. On the contrary, if the opening degree of the suction throttle valve is reduced, the suction pressure of the compressor is reduced and the lower evaporating pressure increases to lessen the refrigerating performance. In such a manner, the refrigerating performance is adjustable in accordance with the lower evaporating pressure by the action of the suction throttle valve.

In an another preferred embodiment, the method of operating a refrigerating system is provided, wherein the refrigerant is carbon dioxide.

In this regard, ethylene ($C_2H_4$), diborane ($B_2H_6$), ethane ($C_2H_6$), nitrogen oxide or others may be employed as the refrigerant, besides carbon dioxide ($CO_2$).

In accordance with another aspect of the present invention, there is provided a refrigerating system which includes at least a compressor, a heat-dissipation type heat exchanger, throttling means and a heat-absorption type heat exchanger which are connected in series with each other to form a closed circuit for circulating a refrigerant, the closed circuit including a first refrigerant circuit section having a higher pressure and a second refrigerant circuit section having a lower evaporating pressure, wherein the refrigerating system is adapted so that the higher pressure of the closed circuit becomes the supercritical pressure of the refrigerant circulating in the closed circuit, and further includes a control means operative to increase the lower evaporating pressure of the second circuit section in accordance with a predetermined control characteristic property when the higher pressure of the first circuit section increases.

Preferably, the compressor of the refrigerating system is a variable displacement type compressor adapted so that the discharge capacity of the variable displacement type compressor is adjustably controlled by the control means.

Further preferably, the variable displacement type compressor of the refrigerating system is controlled by the control means so that the discharge capacity thereof is reduced as the higher pressure of the first circuit section increases.

More further preferably, the compressor of the refrigerating system further includes a first sensor for detecting a pressure of the refrigerant prior to being compressed by the compressor; and a second sensor for detecting a pressure of the refrigerant after being compressed; and the control means determines a target value for the lower evaporating pressure in correspondence to the higher pressure detected by the second sensor, based on the predetermined control characteristic property defined to increase the target value for the lower evaporating pressure detected by the first sensor as the higher pressure detected by the second sensor increases, and reduces the discharge capacity of the compressor so that the lower evaporating pressure coincides with the target value when the value of the lower evaporating pressure is detected by the first sensor lower than the target value.

In a preferred embodiment, the above-described refrigerating system is conducted, wherein the compressor is a fixed displacement type compressor, wherein the refrigerating system includes a suction throttle valve provided at a position upstream from the fixed displacement type compressor in the closed circuit, and wherein the suction pressure of the fixed displacement type compressor is adjustably controlled by adjustably changing the opening degree of the suction throttle valve in accordance with the lower evaporating pressure of the refrigerant prior to entering the compressor.

BRIEF DESCRIPTION OF THE DRAWINGS

The above and other objects, features and advantages of the present invention will be made more apparent from the following description of the preferred embodiments thereof, with reference to the accompanying drawings wherein.

DESCRIPTION OF THE PREFERRED EMBODIMENTS

First Embodiment

Figure 1:
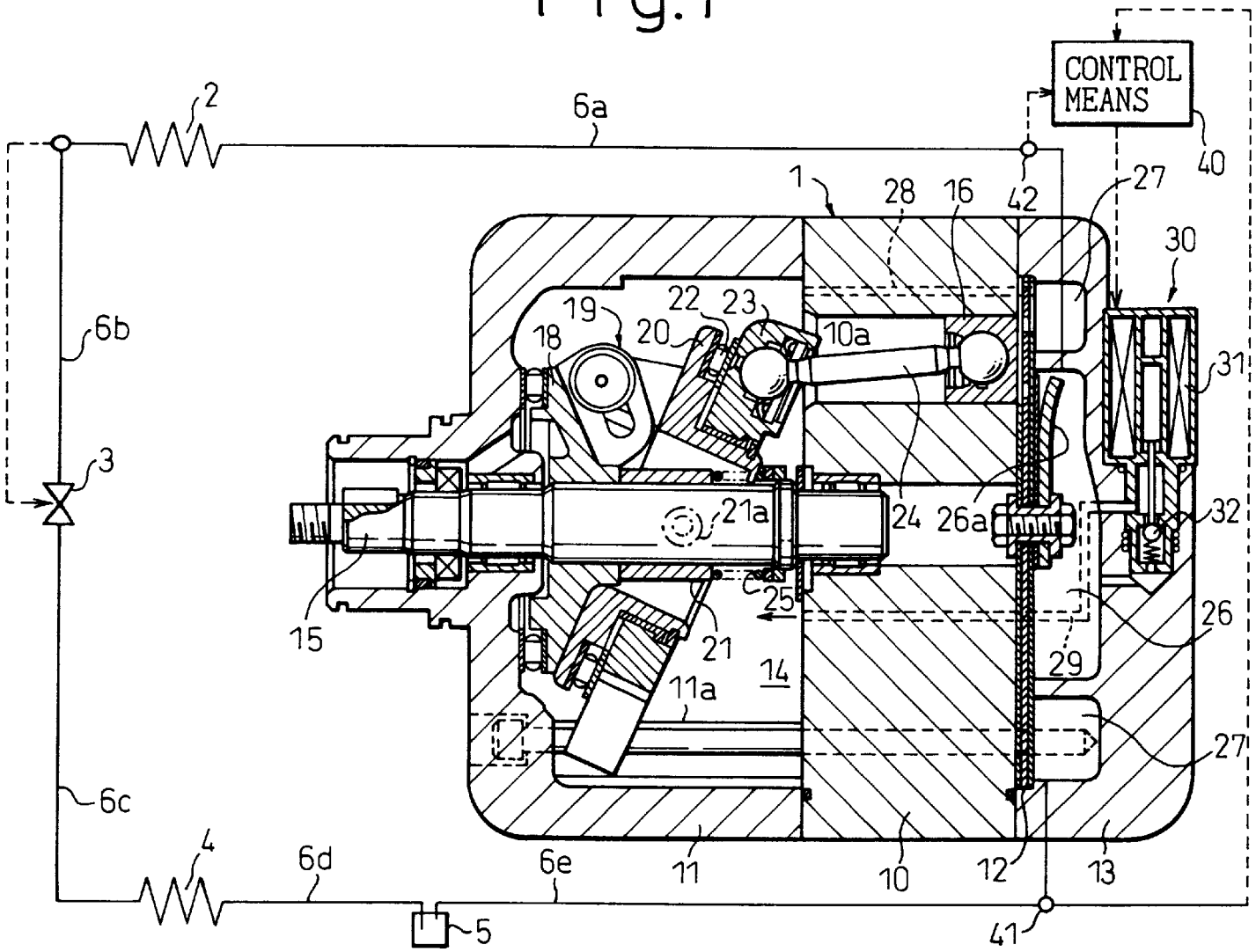
FIG. 1 is a side sectional view of a variable displacement type compressor used for a first embodiment of a refrigerating system for an automobile, illustrating a circuit structure thereof.

A refrigerating system shown in FIG. 1 is used for an air-conditioner for an automobile, and includes a closed circuit including a compressor 1, a gas cooler 2 used as a heat-dissipation type heat exchanger, an expansion valve 3 used as a throttling means, an evaporator 4 used as a heat-absorption type heat exchanger and an accumulator 5 used as a vapor-liquid separator, which are connected in series with each other. That is, a discharge chamber 26 of the compressor 1 is connected via a pipe 6*a* to the gas cooler 2 which is connected via a pipe 6*b* to the expansion valve 3 which in turn is connected via a pipe 6*c* to the evaporator 4 which is then connected via a pipe 6*d* to the accumulator 5 which is again connected via a pipe 6*e* to a suction chamber 27 of the compressor 1, so that a closed refrigerant circuit is completed.

The closed circuit includes a first refrigerant circuit section having a higher pressure and a second refrigerant circuit section having a lower evaporating pressure. This refrigerating system operates so that the higher pressure in the refrigeration circuit becomes the supercritical pressure of a refrigerant circulating in the circuit. Carbon dioxide ($CO_2$) is used as a refrigerant. As described before, the opening degree of the expansion valve 3 is controlled based on the detected temperature and pressure of the refrigerant at the exit of the gas cooler 2 so that the relationship between the refrigerant temperature and pressure corresponds to the above-mentioned optimum control curve; i.e., the COP value becomes a maximum.

The compressor 1 is of a variable displacement type capable of varying its discharge flow rate, wherein the discharge rate is reduced in accordance with the increase in the interior pressure of a crank chamber 14 of the compressor 1, while the pressure in the crank chamber 14 becomes higher as the higher pressure increases.

In this compressor 1, a front housing 11 is coupled to a front end of a cylinder block 10, and a rear housing 13 is coupled via a valve plate 12 or others to a rear end of the cylinder block 10. Within the crank chamber 14, defined by the front housing 11 and the cylinder block 10, is accommodated a driving shaft 15, one end of which extends from the front housing 11 and is secured to an armature of an electromagnetic clutch not shown. The driving shaft 15 is supported for rotation by a sealing device and a radial bearing provided between the front housing 11 and the cylinder block 10. In this regard, a thrust bearing and a leaf spring not shown are interposed between the other end of the driving shaft 15 and the valve plate 12 or others. Also, a plurality of bores 10*a* are provided in the cylinder block 10 at positions encircling the driving shaft 15, and accommodate therein pistons 16, respectively.

Within the crank chamber 14, a rotor 18 is fixed to the driving shaft 15 via a thrust bearing at a distance from the front housing 11 to be rotatable in synchronism with the driving shaft 15, and a rotary swash plate 20 is pivoted behind the rotor 18 via a hinge mechanism 19 to be rotatable in synchronism with the rotor 18. A sleeve 21 is slidably fitted onto the circumference of the driving shaft 15 in the crank chamber 14, and the rotary swash plate 20 is rockably pivoted on a pin 21*a* projected from the sleeve 21. On the rotary swash plate 20 is held, via a thrust bearing 22 or the like, a rocking swash plate 23, to which an anti-rotation pin, not shown, movable solely in the axial direction in an anti-rotation groove 11*a* of the front housing, is fixed. A rod 24 is provided between the rocking swash plate 23 and the respective piston 16 to be held thereby, so that the respective piston is reciprocated within the respective bore 10*a* in accordance with inclination angles of the rocking swash plate 23.

A compressive spring 25 is provided between the sleeve 21 and a circlip fixed onto the driving shaft 15 on the side of the cylinder block 10. By the action of the compressive spring 25, the rotary swash plate 20 is capable of abutting to the rotor 18, whereby the rocking swash plate 23 is maintained at the maximum angle at the starting point. When the compressive spring 25 is compressed to the maximum extent, the rocking swash plate 23 is kept at the minimum inclination angle.

Within the rear housing 13, the discharge chamber 26 is formed in a central region, and the suction chamber 27 is formed outside the discharge chamber 26. Each of compression chambers defined by an end surface of the respective piston 16 and the respective bore 10*a* communicates with the discharge chamber 26 through each of discharge ports formed in the valve plate 12. The respective discharge port is openable and closable by the action of a discharge valve, the opening degree of which is controllable on the side of discharge chamber 26 by a retainer 26*a*. The respective compression chamber communicates with the suction chamber 27 through each of suction ports formed in the valve plate 12, wherein the respective suction port is openable and closable on the side of the respective compression chamber by the action of a suction valve.

An air-extraction path 28 for communicating the crank chamber 14 with the suction chamber 27 is provided in the rear housing 13, the valve plate 12, the cylinder block 10 or others. Also, an air-feeding path 29 is formed as a control path for communicating the discharge chamber 26 with the crank chamber 14. In this regard, a volumetric control valve 30 is provided in the rear housing 13 at a position midway of the air-feeding path 29.

In the volumetric control valve 30, a ball-like valve body 32 is displaceable upward/downward by the action of a solenoid 31 to adjust the opening degree of the air-feeding path 29.

The solenoid 31 controllable by a control means 40. A value of a lower evaporating pressure detected by a pressure sensor 41 provided in the pipe 6*e* upstream from the compressor 1 and a value of a higher pressure detected by a pressure sensor 42 provided in the pipe 6*a* downstream from the compressor 1 are input to the control means 40. A control characteristic property defined so that, as the higher pressure increases, the lower evaporating pressure becomes higher is preliminarily stored in the control means 40 (such a control characteristic property is shown as a straight line in FIG. 2 of upward slope defined by an equation: y=ax+b, wherein a>0 and the x-y coordinates are defined so that the x axis represents the higher pressure and the y axis represents the lower evaporating pressure).

According to the refrigerating system as structured above, the rotation of an engine, not shown, is transmitted as a driving source to the driving shaft 15 of the compressor 1 via an electromagnetic clutch. In the compressor 1, the rotary swash plate 20 is made to rotate at a predetermined inclination angle in synchronism with the rotor 18 by the rotation of the driving shaft 15, wherein solely a rocking motion of the rotary swash plate 20 is transmitted to the rocking swash plate 23. Accordingly, the piston 16 reciprocates within the cylinder 10*a* via the rod 24 due to the rocking motion of the rocking swash plate 23. Thus, the refrigerant in the suction chamber 27 is compressed in the compression chamber, and then discharged into the discharge chamber 26. The refrigerant discharged into the discharge chamber 26 is supplied to the gas cooler 2 via the pipe 6*a*.

The refrigerant at a high temperature and at a high pressure is cooled by the gas cooler 2 to a temperature approximately equal to that of environmental air, and the cooled refrigerant is supplied to the expansion valve 3 via the pipe 6*b*. The refrigerant supplied to the expansion valve 3 is decompressed by the above-mentioned control, based on the refrigerant temperature and pressure, at the exit of the gas cooler 2 and is converted into a mist of low temperature and low pressure (in a vapor-liquid phase). The refrigerant thus converted into the mist phase is supplied to the evaporator 4 through the pipe 6*c* and vaporized thereby. At that time, an environmental air is cooled by heat of evaporation whereby the interior of a car cabin is cooled. Thereafter, the refrigerant is supplied via the pipe 6*d* to the accumulator 5, wherein a liquid-phase refrigerant is retained in the accumulator 5, while a vapor-phase refrigerant is again taken into the suction chamber 27 of the compressor 1 through the pipe 6*e*.

In this period, the discharge capacity of the compressor 1 can be controlled at any time by the control means 40. That is, a value of the lower evaporating pressure detected by the pressure sensor 41 provided in the pipe 6*e* upstream from the compressor 1 and a value of the higher pressure detected by the pressure sensor 42 provided in the pipe 6*a* downstream from the compressor 1 can be input at any time into the control means 40. If the detected value of the lower evaporating pressure is lower than a target value therefor determined in correspondence to the detected value of the higher pressure, based on the above-mentioned control characteristic property (a straight line defined by y=ax+b), the discharge capacity of the compressor 1 is reduced so that the lower evaporating pressure coincides with the target value. The reduction of discharge capacity is achieved by increasing the opening degree of the air-feeding path 29 by the displacement of the ball-like valve body 32 due to the operation of the solenoid 31 based on a signal from the control means 40 to increase a supply rate of refrigerant at a discharge pressure Pd in the discharge chamber 26 into the crank chamber 14 so that a pressure Pc in the crank chamber 14 becomes higher. When the pressure Pc within the crank chamber 14 becomes higher, a back pressure applied on the piston 16 increases to reduce the inclination angle of the rotary swash plate 20 and the rocking swash plate 23, whereby the stroke of the piston 16 becomes smaller to reduce the discharge capacity. If the discharge capacity of the piston 16 is reduced, the lower evaporating pressure increases based thereon. Accordingly, the relationship represented by the equation $y \geqq ax+b$ is satisfied between the higher pressure and the lower evaporating pressure. If the discharge capacity of the compressor 1 is variable while the lower evaporating pressure is used as a preset pressure, the control characteristic property is achievable, wherein the higher the higher pressure, the higher the lower evaporating pressure; i.e., the preset pressure.

For this reason, when the rotational speed of the driving shaft 15 of the compressor 1 increases due to the increase of the engine rotational speed, the higher pressure quickly increases while the lowering of the lower evaporating pressure is delayed because of the delay of the throttling operation of the throttling means 3. However, if the refrigerating system is operated to satisfy the above-mentioned control characteristic property, the lower evaporating pressure quickly lowers below the preset value, whereby it is possible to promptly reduce the circulation rate of refrigerant to quickly regulate the refrigerating performance so that excessive refrigeration is assuredly avoidable even though the refrigerating system is operated at a high rotational speed.

In the first embodiment, the description was made of an example wherein the volumetric control valve 30 is provided in the air-feeding path 29 for communicating the crank chamber 14 with the discharge chamber 26 to regulate the interior pressure Pc in the crank chamber 14 in accordance with a supply rate of the discharge pressure Pd into the crank chamber 14. However, means for regulating the interior pressure Pc of the crank chamber 14 is no limited thereto. For example, the volumetric control valve 30 may be provided in the air-extraction path 28 for communicating the crank chamber 14 with the suction chamber 27 to regulate the interior pressure Pc in the crank chamber 14 by controlling the air-extraction rate from the crank chamber 14 to the suction chamber 27.

Figure 2:
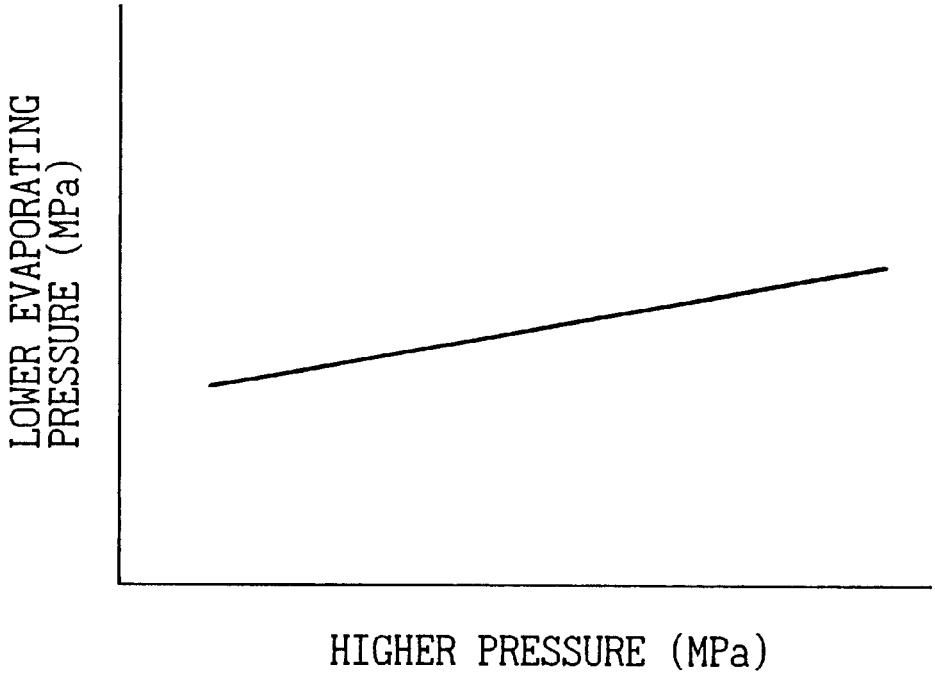
FIG. 2 illustrates a control characteristic property in the first embodiment of the refrigerating system.

Also, in the first embodiment, the straight line shown in FIG. 2 is employed as a control characteristic property, but lines other than a straight line may be employed.

Second Embodiment

Figure 3A:
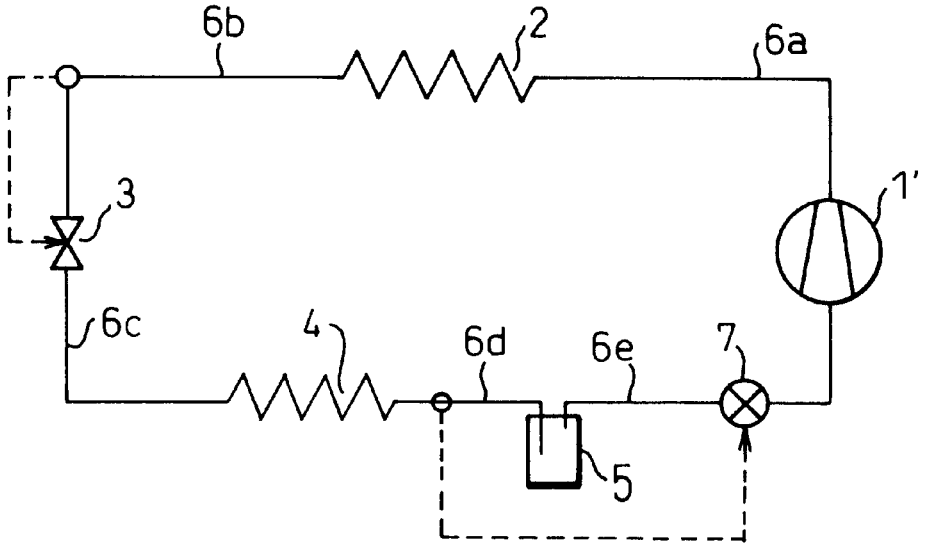
FIG. 3A is a block diagram illustrating a circuit structure of a second embodiment of a refrigerating system for an automobile.
Figure 3B:
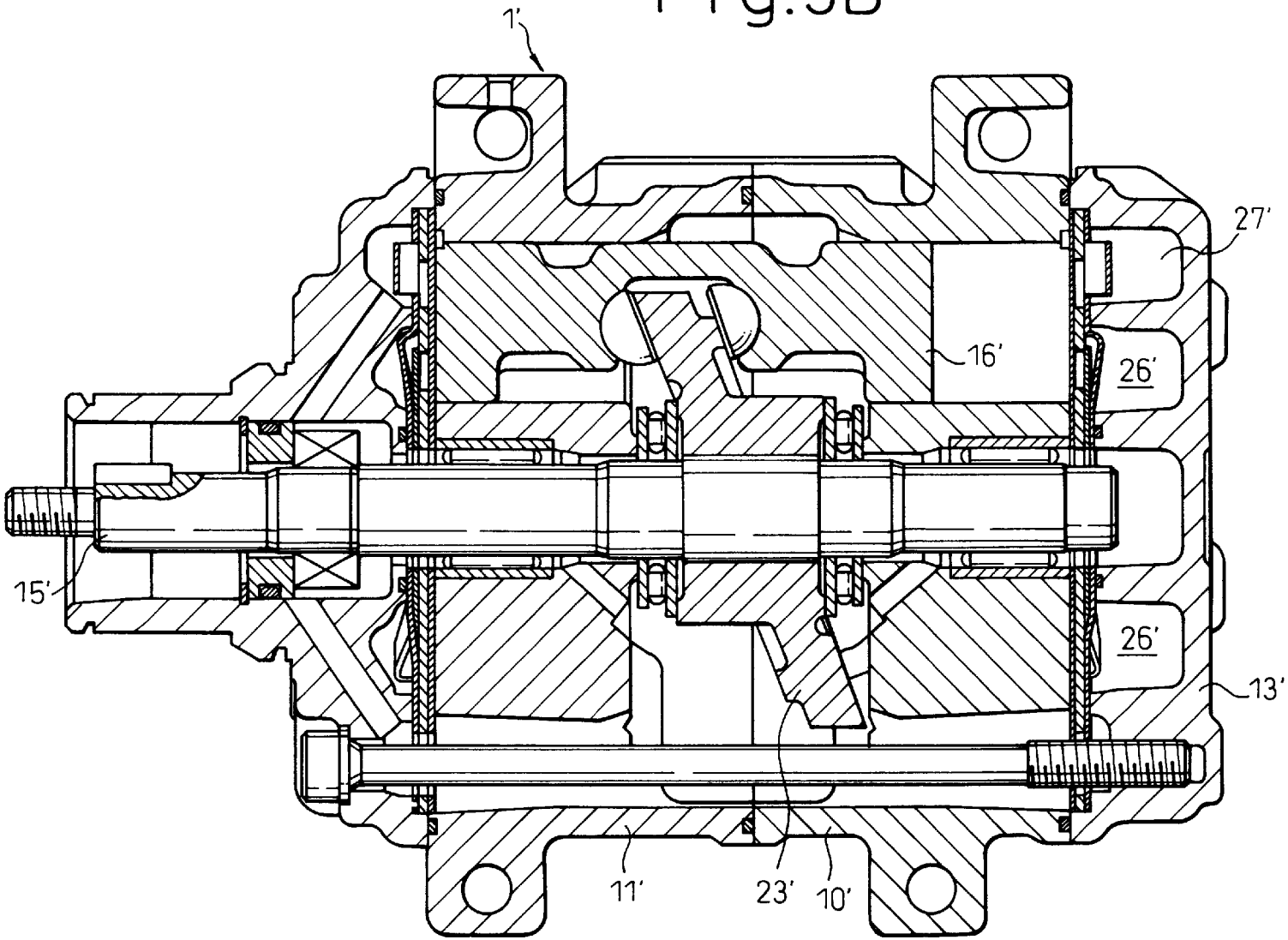
FIG. 3B is a side sectional view of a fixed displacement type compressor shown in FIG. 3A used for the second embodiment of the refrigerating system.

A refrigerating system shown in FIG. 3A is similar to the first embodiment mentioned above, but a fixed displacement type compressor as shown in FIG. 3B is used as a compressor 1', a suction throttle valve 7 is provided upstream from the compressor 1' in a pipe 6*e* between the compressor 1' and an accumulator 5, and the control means 40 and the pressure sensors 41, 42 are eliminated.

In the fixed displacement type compressor shown in FIG. 3B, a swash plate 23' in which the inclination angle is fixed is used. In this drawings, the same parts as in FIG. 1 are indicated by the same reference numerals while adding a dash (') to differentiate them.

The opening degree of the suction throttle valve 7 is controlled based on a detected value of a refrigerant pressure at the exit of evaporator 4, i.e., the lower evaporating pressure. If the lower evaporating pressure is higher than the preset value, the opening degree thereof is made to increase, while if the lower evaporating pressure is lower than the preset value, the opening degree is made to reduce. When the opening degree of the suction throttle valve 7 increases, the suction pressure of the compressor 1' increase to lower the lower evaporating pressure so that the refrigerating performance becomes higher. On the contrary, when the opening degree of the throttle valve 7 is reduced, the suction pressure of the compressor 1' lowers to increase the lower evaporating pressure so that the refrigerating performance becomes lower. In such a manner, the refrigerating performance is adjustable in accordance with the lower evaporating pressure.

If the same control characteristic property as in the first embodiment is applied to such a refrigerating system, wherein the lower evaporating pressure becomes higher as the higher pressure increases, it is possible to quickly adjust the refrigerating performance when the rotational speed increases, to securely prevent an excessive refrigeration.

Third Embodiment

Figure 4:
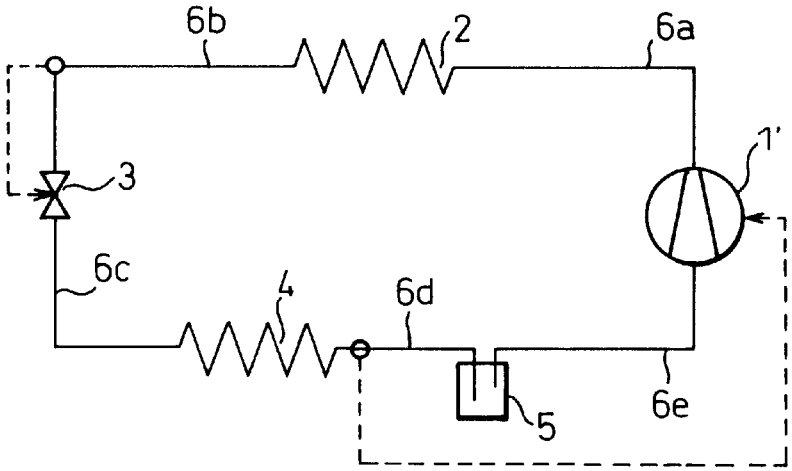
FIG. 4 is a block diagram illustrating a circuit structure of a third embodiment of a refrigerating system for an automobile.

A refrigerating system shown in FIG. 4 has the same structure as the first embodiment, except that a fixed displacement type compressor is used as the compressor 1' and controlled in an ON-OFF manner in accordance with the detected results of the evaporating pressure, and the control means 40 and the pressure sensors 41, 42 are eliminated.

Figure 5:
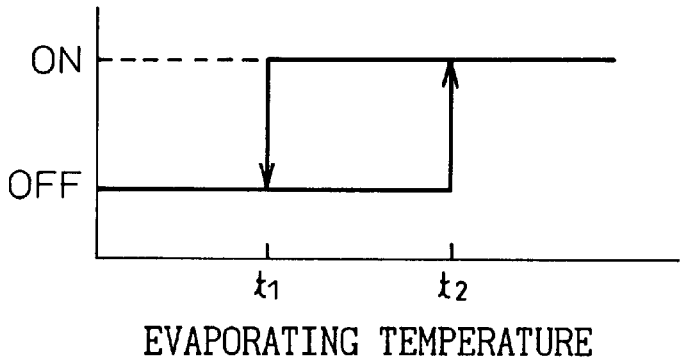
FIG. 5 illustrates an ON/OFF control of a compressor in the third embodiment of the refrigerating system.

That is, according to this refrigerating system, the refrigerant temperature is detected at the exit of the evaporator 4. As shown in FIG. 5, when the detected temperature is lower than a first preset temperature $t_1$, an electromagnetic clutch of the compressor 1' is turned off, while when an evaporating temperature is higher than a second preset temperature $t_2$ ($>t_1$), the electromagnetic clutch of the compressor 1' is turned on. In this regard, the evaporating temperature corresponds to the evaporating pressure.

Figure 6:
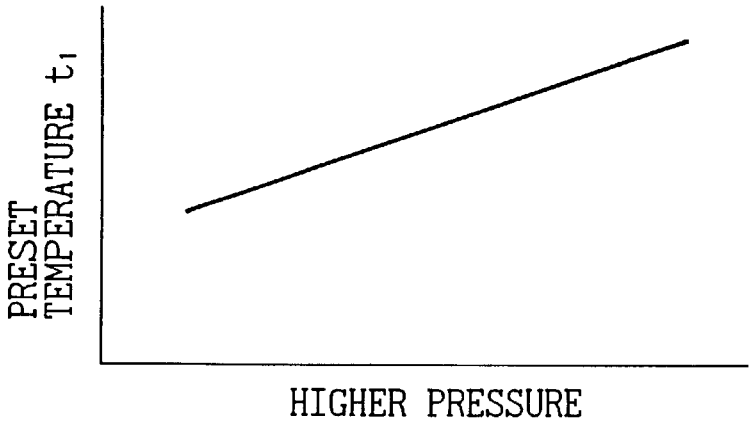
FIG. 6 illustrates a control characteristic property in the third embodiment of the refrigerating system.
Figure 7:
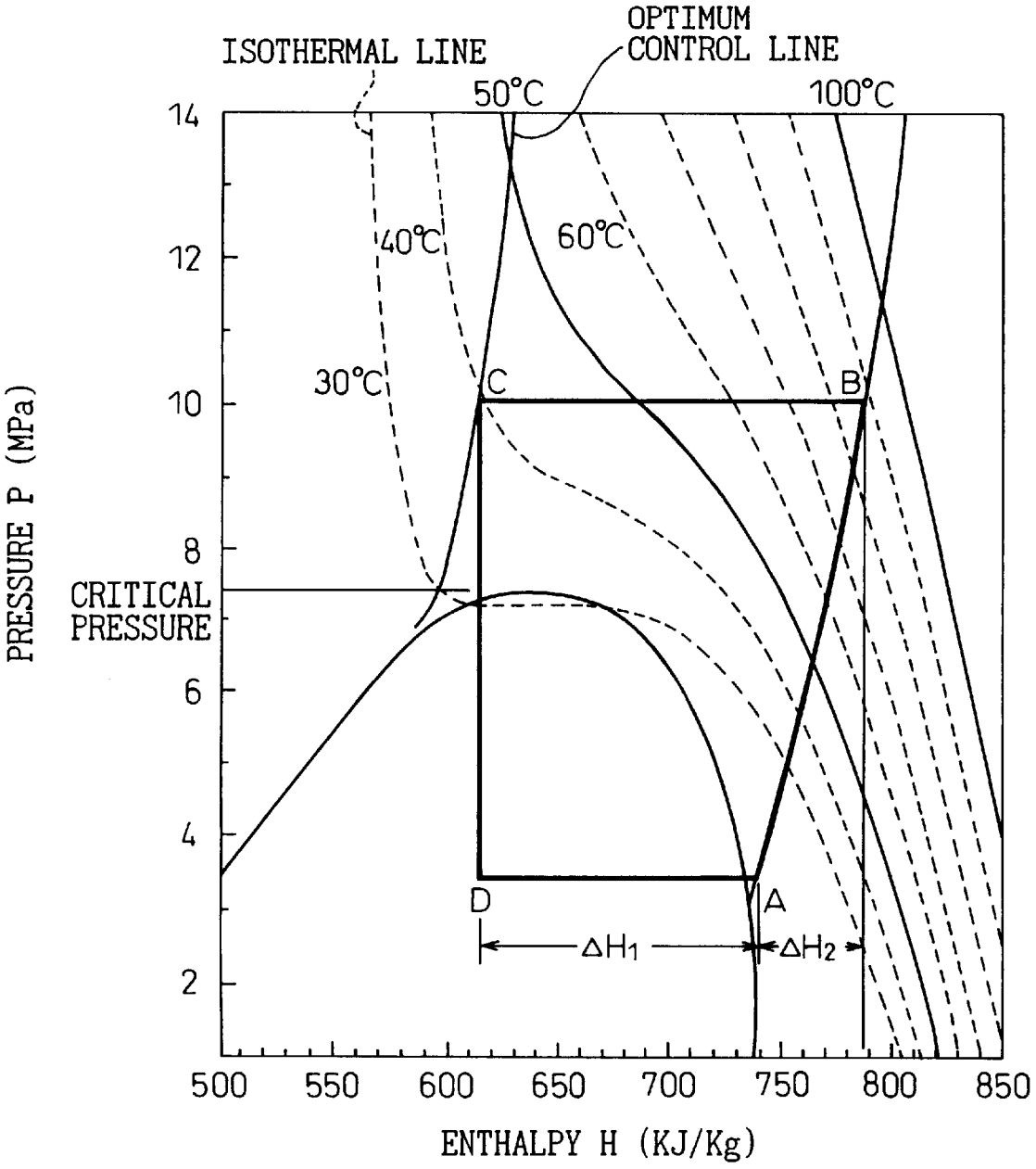
FIG. 7 illustrates a pressure-enthalpy diagram of supercritical cycle using carbon dioxide ($CO_2$) as a refrigerant.

If a control characteristic property shown in FIG. 6, wherein the first preset temperature $t_1$ becomes higher as the higher pressure becomes higher, is applied to this refrigerating system, the evaporating temperature (lower evaporating pressure) becomes lower than the first preset temperature $t_1$, while the former is still in a higher range, to turn off the magnetic clutch of the compressor 1'. Thus, it is possible to assuredly prevent excessive refrigeration from occurring when the rotational speed increases.

We claim:

1. A method of operating a refrigerating system which includes at least a compressor, a heat-dissipation type heat exchanger, throttling means and a heat-absorption type heat exchanger which are connected in series with each other to form a closed circuit for circulating a refrigerant, said closed circuit including a first refrigerant circuit section having a higher pressure and a second refrigerant circuit section having a lower evaporating pressure, wherein the method comprises the steps of:

operating said refrigerating system so that the higher pressure in said closed circuit becomes the supercritical pressure of said refrigerant circulating in said closed circuit; and controlling said refrigerating system so that the lower evaporating pressure increases as the higher pressure increases.

2. The method of operating a refrigerating system according to claim 1, wherein a variable displacement type compressor capable of varying a discharge capacity is used as said compressor.

3. The method of operating a refrigerating system according to claim 2, wherein the discharge capacity of said variable displacement type compressor is reduced as the higher pressure in said first circuit section increases.

4. The method of operating a refrigerating system according to claim 3, wherein the method further comprises the steps of:

detecting a refrigerant pressure prior to compression as the lower evaporating pressure and a refrigerant pressure after compression as the higher pressure, respectively;

predetermining a control characteristic property so that a target value for the lower evaporating pressure in said closed circuit increases as the higher pressure in said closed circuit increases;

determining said target value for the lower evaporating pressure corresponding to the detected higher pressure based on said predetermined control characteristic property; and reducing the discharge capacity of said compressor so that the lower evaporating pressure coincides with said target value, when the detected lower evaporating pressure is lower than said determined target value for the lower evaporating pressure.

5. The method of operating a refrigerating system according to claim 4, wherein said control characteristic property represents a generally upwardly inclined straight line shown in coordinates defined by an ordinate representing the lower evaporating pressure and an obscissa representing the higher pressure.

6. The method of operating a refrigerating system according to claim 4, wherein the lower evaporating pressure of said refrigerant is a detected pressure of the refrigerant prior to being taken into said compressor, and the higher pressure of said refrigerant is a detected pressure of said refrigerant discharged from said compressor.

7. The method of operating a refrigerating system according to claim 1, wherein a fixed displacement type compressor is used as said compressor and a suction throttle valve is provided at a position upstream from said fixed displacement type compressor in said closed circuit, and wherein the suction pressure of said fixed displacement type compressor is adjustably controlled by adjustably changing the opening degree of said suction throttle valve in accordance with the lower evaporating pressure of said refrigerant prior to entering said compressor.

8. The method of operating a refrigerating system according to claim 1, wherein the refrigerant is carbon dioxide.

9. A refrigerating system which includes at least a compressor, a heat-dissipation type heat exchanger, throttling means and a heat-absorption type heat exchanger which are connected in series with each other to form a closed circuit for circulating a refrigerant, said closed circuit including a first refrigerant circuit section having a higher pressure and a second refrigerant circuit section having a lower evaporating pressure, wherein said refrigerating system is adapted so that the higher pressure of said closed circuit becomes the supercritical pressure of said refrigerant circulating in said closed circuit, and further includes a control means operative to increase the lower evaporating pressure of said second circuit section in accordance with a predetermined control characteristic property when the higher pressure of said first circuit section increases.

10. The refrigerating system according to claim 9, wherein said compressor is a variable displacement type compressor adapted so that the discharge capacity of said variable displacement type compressor is adjustably controlled by said control means.

11. The refrigerating system according to claim 10, wherein said variable displacement type compressor is controlled by said control means so that the discharge capacity thereof is reduced as the higher pressure of said first circuit section increases.

12. The refrigerating system according to claim 11, wherein said variable displacement type compressor further includes:

a first sensor for detecting a pressure of said refrigerant prior to being compressed by said compressor; and a second sensor for detecting a pressure of said refrigerant after being compressed; and wherein said control means determines a target value for the lower evaporating pressure in correspondence to the higher pressure detected by said second sensor based on the predetermined control characteristic property defined to increase the target value for the lower evaporating pressure detected by said first sensor as the higher pressure detected by said second sensor increases, and reduces the discharge capacity of said compressor so that the lower evaporating pressure coincides with said target value when the value of the lower evaporating pressure detected by said first sensor is lower than said target value.

13. A refrigerating system according to claim 9, wherein said compressor is a fixed displacement type compressor, wherein said refrigerating system includes a suction throttle valve provided at a position upstream from said fixed displacement type compressor in said closed circuit, and wherein the suction pressure of said fixed displacement type compressor is adjustably controlled by adjustably changing the opening degree of said suction throttle valve in accordance with the lower evaporating pressure of said refrigerant prior to entering said compressor.

* * * * *

UNITED STATES PATENT AND TRADEMARK OFFICE

CERTIFICATE OF CORRECTION

PATENT NO. : 6,105,380
DATED : August 22, 2000
INVENTOR(S) : Yokomachi et al.

It is certified that error appears in the above-identified patent and that said Letters Patent is hereby corrected as shown below:

Column 1,
Line 4, delete "(such an", insert therefor -- (such a --.

Column 2,
Line 4, delete "(such an", insert therefor -- (such a --.
Line 16, delete "increases and as a mass flow", insert therefor -- increases and has a mass flow --.

Column 12,
Line 28, delete "is no limited to", insert therefor -- is not limited to --.
Line 48, delete "In this drawings", insert therefor -- In this drawing --.

Signed and Sealed this

Seventh Day of May, 2002

*Attest:*

*Attesting Officer*

JAMES E. ROGAN
*Director of the United States Patent and Trademark Office*